US011592015B2

(12) United States Patent
Laurent

(10) Patent No.: US 11,592,015 B2
(45) Date of Patent: Feb. 28, 2023

(54) DEVICE FOR VACUUM-PACKING A PRODUCT IN AN AIRTIGHT CONTAINER IN ORDER TO KEEP THE PRODUCT FRESH LONGER

(71) Applicant: Hervé Laurent, Paris (FR)

(72) Inventor: Hervé Laurent, Paris (FR)

( * ) Notice: Subject to any disclaimer, the term of this patent is extended or adjusted under 35 U.S.C. 154(b) by 211 days.

(21) Appl. No.: 15/505,591

(22) PCT Filed: Aug. 18, 2015

(86) PCT No.: PCT/FR2015/052221

§ 371 (c)(1),
(2) Date: Feb. 22, 2017

(87) PCT Pub. No.: WO2016/027032

PCT Pub. Date: Feb. 25, 2016

(65) Prior Publication Data

US 2018/0058435 A1 Mar. 1, 2018

(30) Foreign Application Priority Data

Aug. 20, 2014 (FR) ..... 14 57904

(51) Int. Cl.

| | |
|---|---|
| ***F04B 37/14*** | (2006.01) |
| ***F04B 35/06*** | (2006.01) |
| ***F04B 39/12*** | (2006.01) |
| ***B65B 31/04*** | (2006.01) |

(52) U.S. Cl.

CPC ..... *F04B 37/14* (2013.01); *B65B 31/047* (2013.01); *F04B 35/06* (2013.01); *F04B 39/123* (2013.01)

(58) Field of Classification Search

CPC ..... F04B 37/14; F04B 35/06; F04B 39/123; B65B 31/047; B65B 31/04

See application file for complete search history.

(56) References Cited

U.S. PATENT DOCUMENTS

| | | | | | |
|---|---|---|---|---|---|
| 2,576,322 | A | * | 11/1951 | Waters | B65B 31/046 206/524.8 |
| 2,636,657 | A | * | 4/1953 | Lauritzen | B65B 31/046 53/275 |
| 5,121,590 | A | * | 6/1992 | Scanlan | B65B 31/047 137/533.21 |
| 5,396,751 | A | * | 3/1995 | Chi | B65B 31/047 53/405 |
| 5,765,608 | A | * | 6/1998 | Kristen | B65B 31/047 141/96 |

(Continued)

*Primary Examiner* — Christopher R Harmon

(74) *Attorney, Agent, or Firm* — Notaro, Michalos & Zaccaria P.C.

(57) ABSTRACT

The device consists of two separate parts: a stationary unit (12) which contains a motor (16) and vacuum pump (14), and a mobile head (20) with a power-supply switch for the motor and an aspirating nozzle designed to fit over the valve (32) in the lid of an airtight container (28, 30). The mobile head connects to the stationary unit with two flexible coaxial spiral cords, consisting of a hose (22) linking the vacuum pump and aspirating nozzle, and a power cord (36) linking the switch to the electrical motor. Both lines can easily be stretched together from the storage position, in which the mobile head sits on the stationary unit, to active mode, in which the suction effect keeps the mobile head coupled to the container.

7 Claims, 3 Drawing Sheets

(56) References Cited

U.S. PATENT DOCUMENTS

| | | | | |
|---|---|---|---|---|
| 6,968,870 | B1 * | 11/2005 | Tsay | B65B 31/047 141/65 |
| 7,127,875 | B2 * | 10/2006 | Cheung | B65B 31/047 53/510 |
| 7,530,212 | B2 * | 5/2009 | Lee | B65B 31/02 53/390 |
| 2005/0028493 | A1 * | 2/2005 | Small | A47L 9/0036 53/510 |
| 2005/0035021 | A1 * | 2/2005 | Higer | B65B 31/047 206/524.8 |
| 2005/0074342 | A1 * | 4/2005 | Lemme | B65B 31/047 417/415 |
| 2007/0212239 | A1 * | 9/2007 | Heil | B65B 31/047 417/437 |
| 2009/0193760 | A1 * | 8/2009 | Leclear | B65B 31/046 312/401 |

* cited by examiner

DEVICE FOR VACUUM-PACKING A PRODUCT IN AN AIRTIGHT CONTAINER IN ORDER TO KEEP THE PRODUCT FRESH LONGER

The present invention belongs to a category of devices which create a vacuum inside a sealed container, in order to keep a product inside the container fresh longer.

In the following pages, the present invention is described in the more specific context of keeping food products fresh, but it can be used to reduce the oxidation of many other types of products. For example, vacuum-packing can prevent leftover house paint in open cans from drying out, or to keep metal parts from rusting, etc.

This invention can also be used to create a vacuum inside a bottle to preserve a beverage such as wine, for example, from oxidation, after the bottle has been uncorked.

Lastly, the container to be vacuum-sealed can be either rigid (a plastic tub, etc.) or flexible (an airtight sac or bag).

The vacuum is created by a device containing an electric motor which powers a vacuum pump. A hose on the pump is fitted with an aspirating nozzle which fits snugly over a valve on the lid of the vessel containing the product.

Most of the devices currently on the market consist of a hand-held, one-piece motor-and-pump assembly fitted with an aspirating nozzle. A pushbutton electrical switch on the motor unit turns it on and off. The device is held in the hand and the nozzle is applied to the valve on the container. The user then pushes the button to turn the pump on, and maintains the device on the valve while the air is pumped out of the container. In some cases, the device is equipped with a pressure gauge which may activate a light indicating when the desired level of vacuum has been reached.

The fact that the device must be held in place makes it relatively difficult to use, especially for larger containers which contain a greater volume of air and are therefore slower to empty. The user must maintain an airtight seal by holding the device on the container throughout the pumping operation, keeping an eye on the indicator light, if one is present. He must then switch the motor off, remove the nozzle from the container, and put the device away.

Other systems consist of pumps linked to a mechanism which seals the opening in an airtight bag. The aspirating nozzle is connected to the pump by means of a hose. These systems are cumbersome, and are not really appropriate for home vacuum-packing applications. Moreover, the aspirating nozzle and hose must be removed (which complicates the maneuver) or remain permanently hooked up to the machine (which is both inconvenient and unattractive).

Moreover, the various existing devices are noisy. When they are operating, the small 12-volt motor, which is loud by nature, emits an especially high-pitched and unpleasant noise, even if the motor is not strained.

One of the purposes of the invention is to remedy the abovementioned drawbacks, by offering a device with the following features:

- it is compact in structure, so that it can be left standing on a kitchen countertop, for instance, or can be stored in a kitchen cabinet;
- once the user has positioned the aspirating nozzle on the valve, the rest is automatic. No further manipulation or supervision is necessary, and the user is free to engage in other activities while the vacuum-packing is underway (an operation which may last more than one minute);

- once the proper vacuum level has been reached, the pump turns off automatically and the aspirating nozzle is automatically disconnected from the container;
- the invention relies on electrical circuitry alone, with no electronics, maximizing the lifespan and reliability of the device.

To this end, the invention consists of a device including the following components, all of which are familiar: an electric motor, a power-supply switch for an electric motor, an electrically-powered vacuum pump, with a hose in which the vacuum pump creates negative air pressure, and an aspirating nozzle connected to the hose of the vacuum pump and designed to be temporarily fitted on to a valve built into the lid of the airtight container, forming an airtight seal.

The particularity of this invention is the way the device is broken down into two separate units with, on the one hand, a stationary unit containing the motor and vacuum pump and, on the other hand, a mobile head containing the aspirating nozzle. The stationary unit and mobile head are connected via a flexible hose with an aspirating nozzle on the end. This hose can easily be uncoiled from its storage position, in which the mobile head rests on the stationary unit, to an active mode, in which the mobile head has been fitted to a valve in the lid of airtight container at some distance from the stationary unit.

The device's various subsidiary features are also advantageous:

- the power-supply switch is located on the mobile head and connected to the stationary unit via a coiled electrical cable that fits inside the coiled air hose. There are two coiled lines from the mobile head to the stationary unit: one is the hose connecting the vacuum pump to the aspirating nozzle and the other is an electrical cord connecting the power-supply switch to the electric motor. The two cords can easily be stretched together from the resting position to the active configuration.
- both lines, the hose and power cord, are coiled, making it easy to stretch the mobile head from the resting position to the active mode by pulling the mobile head;
- the power-supply switch is located on the underside of the mobile head in such a way as to electrically contact the valve of the airtight container, so that when the aspirating nozzle is fitted over the valve, the switch is turned on. Inversely, when the aspirating nozzle disconnects from the valve, the switch automatically turns off;
- the aspirating nozzle is coupled to the valve simply by fitting over it, without locking on; the device moreover includes means to create a controlled air-opening in the hoses to activate the release of the nozzle. It is activated when the negative air pressure created by the vacuum pump reaches a predetermined threshold. When the threshold is reached, the means to create a controlled air-opening in the hoses cause the aspirating nozzle to disconnect from the valve, due to the pressure differential between the inside volume of the airtight container and the piping of the pump mechanism. The means to create a controlled air-opening in the hoses includes a solenoid which controls the opening of a valve associated with the piping, the solenoid being controlled by a pressure Switch which is open by default, calibrated to the above-mentioned
- the valve conceits of a ball nestled in a seat. In the presence of a vacuum Inside the mechanism, the ball remains against the seat. A mobile lever mounted on a metallic part is placed in the core of the solenoid, in such a way as to dislodge the ball from the cup when the solenoid is energized;

the device is devoid of any electronic circuitry for controlling the power supply to the motor;

the stationary unit is equipped with a housing where the flexible cord can be stored in a coiled position; and the mobile head includes a curved tab facilitating the action of pulling on the head, so that the head can easily be drawn out of storage and into the active mode, in which it is positioned over the valve on the lid of the airtight container.

An example of the invention's operation will now be described, referring to the drawings appended to this document. From drawing to drawing, the numbers designating identical parts of the device, or parts which are similar in function, remain the same.

Figure 1:
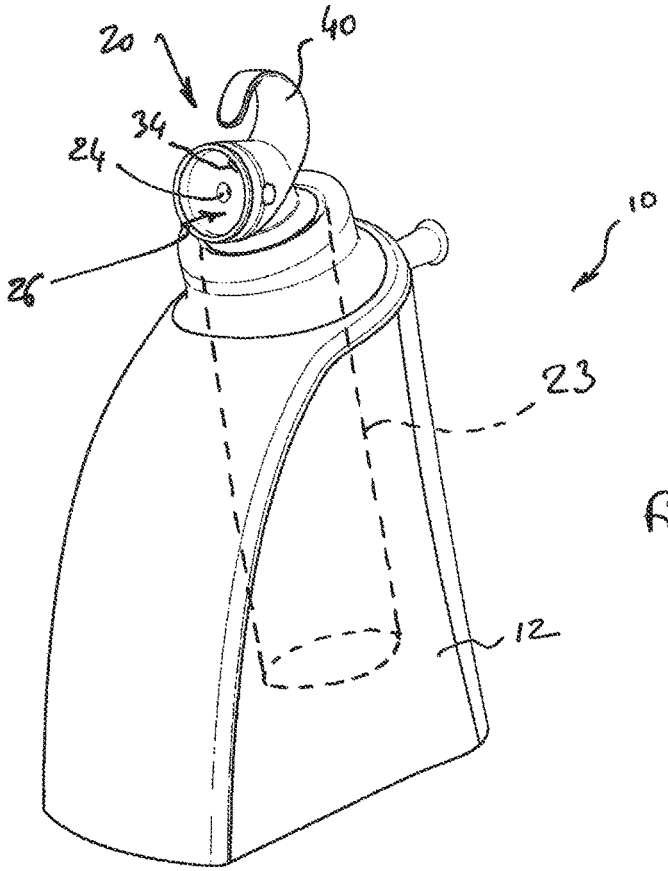
FIG. 1 is a ¾-perspective view of the device in the invention from the front, when it is at rest.
Figure 2:
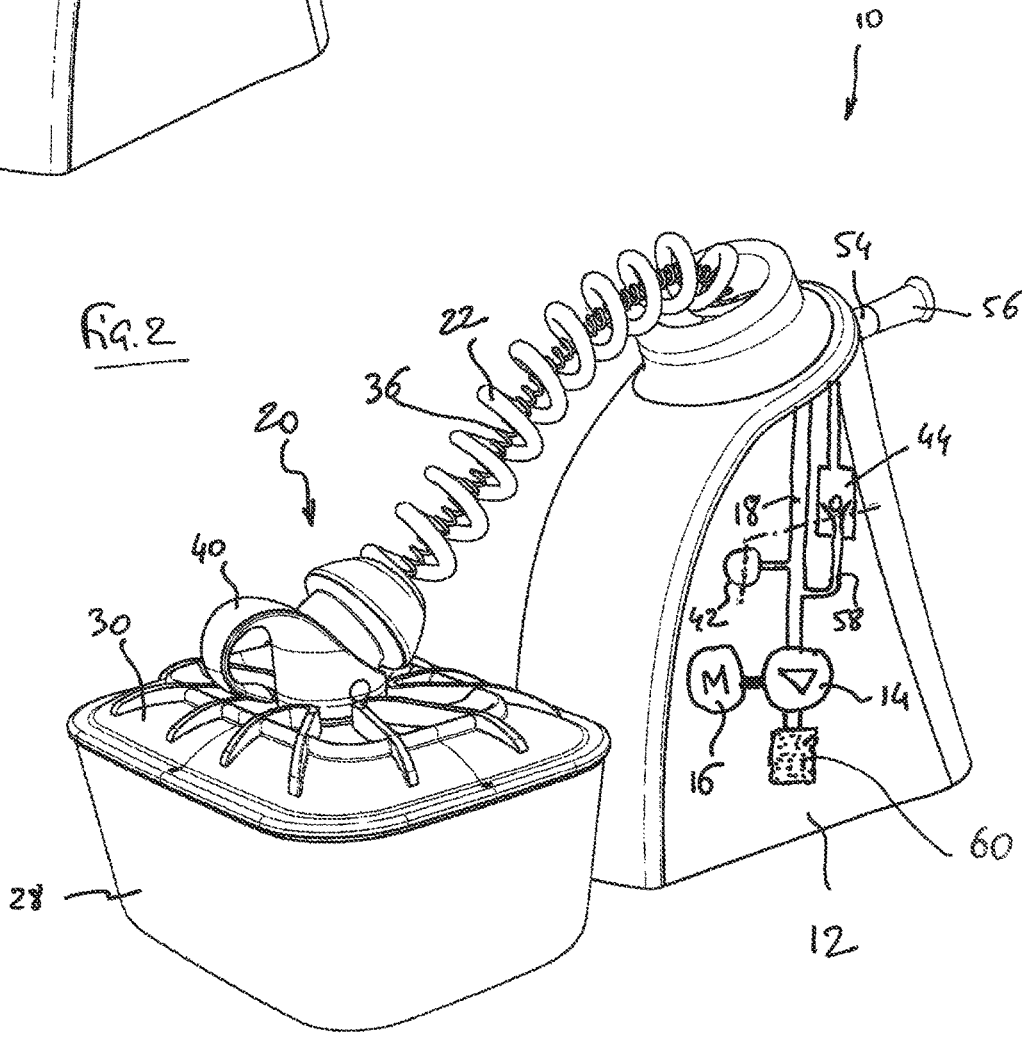
FIG. 2 is a ¾-perspective view of the device, as invented from the front, in use. The mobile head is being applied to the valve on the lid of an airtight container to create a vacuum inside the container.
Figure 3:
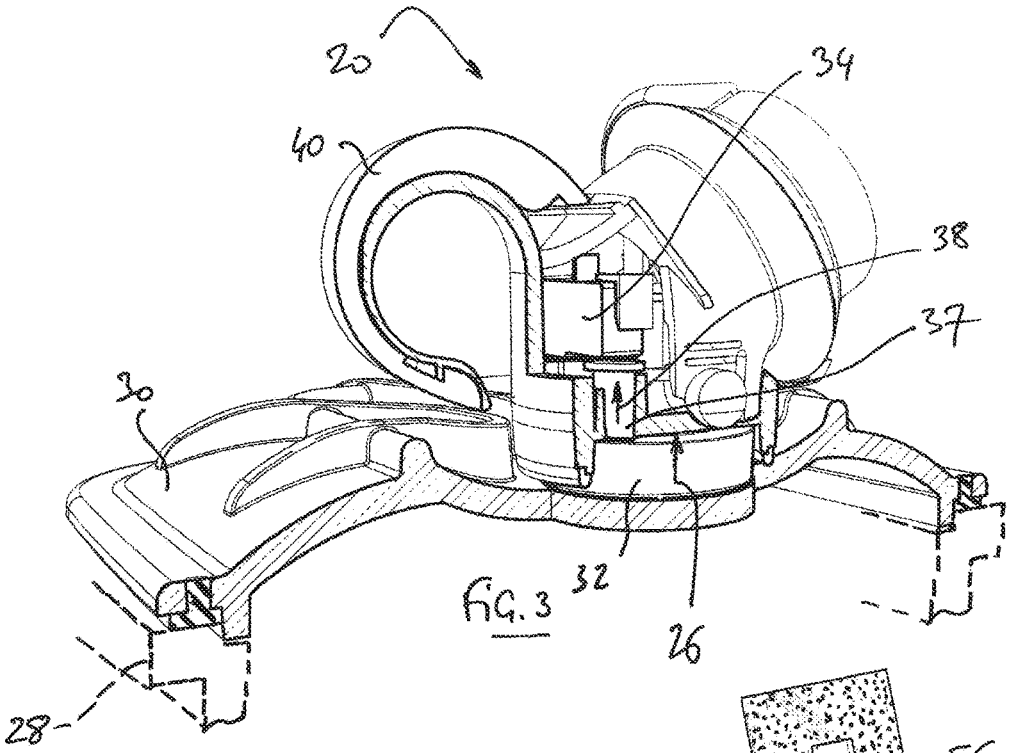
FIG. 3 is a partial cross-section of the mobile head, the lid, and top of the airtight container, in the active mode depicted in FIG. 2.

Referring to FIGS. 1 to 3, the device 10 of the invention is illustrated. It includes a stationary unit 12 housing a vacuum pump 14 driven by an electric motor 16 to create a vacuum in a tube 18. This vacuum is transmitted to a mobile head 20 via hose 22 which ensures an airtight link between the vacuum pump and an aspirating nozzle 24 located on the underside 26 of the mobile head 20.

Mobile head 20 is designed to be presented in an "active" mode corresponding to FIGS. 2 and 3, on a container 28 which closes with an airtight lid 30. This lid 30 is fitted with a valve 32 built into the lid where the user places the underside 26 of the mobile head 20.

In the "storage" mode corresponding to FIG. 1, the hose 22 is coiled in an inner cylinder 23 of stationary unit 12, with only the mobile head 20 emerging from the unit. As a result, the whole appliance is compact and attractive-looking when the device is not in use—that is, most of the time. The apparatus is designed to be stored on a kitchen countertop, for example, like a blender or coffeemaker, so that it is accessible whenever necessary.

In the preferred build, the hose 22 is a "spiral" (that is, coiled) cord, so that when the mobile head is released, it automatically springs back to the housing inside the stationary unit.

Mobile head 20 is also fitted with a power-supply switch 34 controlling the electric motor 16. A power cord 36 connects the mobile head 20 to stationary unit 12. This power cord can be pulled out in the same way and at the same time as hose 22 when the appliance is about to be placed in the active mode.

Switch 34 is very conveniently mounted on the underside 26 of the mobile head 20, and includes an actuating rod 37, either part of the switch or added on, leading to this underside. In this way, the switch is activated (arrow 38, FIG. 3, showing rod 37 activating the switch) as soon as the mobile head is positioned on valve 32 of lid 30 sealing the container to be vacuum packed.

Mobile head 20 is conveniently fitted with a grip 40, either a ring or curved tab, enabling the user to grasp it easily with thumb and forefinger in order to apply the head to the valve in lid 30 of the container to be vacuum packed.

As a result, the pump turns on automatically: switch 34 closes when the mobile head 20 is positioned directly over valve 32, forming an airtight connection. The user does not have to push a button or turn on a switch. Within one to four seconds after the pump is activated (depending on how much air there is in the container), the mobile head 20 sticks to the valve 32 on the lid of the container due to the suction effect. The user can then release the mobile head and engage in other activities. This is an especially advantageous feature for professional cooks and chefs, or even in the home kitchen, when vacuum-packing foods in large bowls which contain a lot of air. For example, it may take more than a minute to vacuum-pack a salad bowl filled with lettuce leaves.

Preferably, the power cord 36 connecting the switch 34 to the motor 16 is a coiled cord, which is coaxial with the coiled hose 22, so that the mobile head can easily be extended to the operating position and spring back to the storage position. These are the ideal conditions for good, simple, reliable operation, with no need for separate manipulations of the hose and power cord, as long as the dimensions and characteristics of these parts have been chosen in such a way as to enable one line to "slide" inside the other one.

Simplified variants of the build can be considered: notably, a variant where, instead of being mounted on the mobile head 20, switch 34 is located on the stationary unit. In this mode, the vacuum pump powers up a little early (before the mobile head has been applied to the lid of the container). However, it does make it possible to dispense with the power cord connecting the mobile head to the stationary unit. Switch 34 would conveniently be placed on the stationary unit next to the collar where the mobile head rests in its storage position, so that the user can flip the switch and start the pump as soon as he or she grasps the mobile head.

Figure 4:
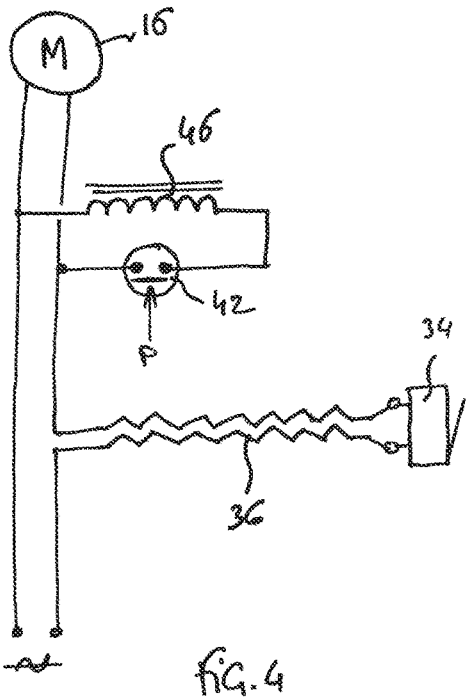
FIG. 4 is a wiring diagram of the present invention.

FIG. 4 is a wiring diagram of the present invention.

To maximize reliability and lifespan, the device does not depend on any electronic circuitry, for either motor power supply control, air pressure gauging, or deactivating the vacuum pump once the desired level of vacuum has been reached.

The fact that the power supply for the motor 16 comes directly from the mains (220 V or 110 V) presents several advantages:

for the same output, those motors are far more reliable than those in 12 V usually installed in this type of appliance, due in particular to their lower rate of RPMs;

because a transformer is unnecessary, the appliance can be more compact, taking up less room and looking more attractive on the kitchen countertop;

the 220/110 V motor adds weight, increasing the stability of the stationary unit 12 which remains in position on the kitchen countertop;

for the same cost, the 220/110 V motor is more powerful, not only increasing vacuum-packing efficiency, but also making it possible to add a noise-reduction system (described in further detail below) consisting of a foam muffler on the pump's exhaust circuit; with no notable negative impact on the pump's performance.

Motor 16 connects directly to the main power supply; switch 34 (at the end of power cord 36) is the only series connection in the circuit. This switch is the "pushbutton" type: that is, in the absence of further mechanical pressure, it springs back to the open position.

The electrical circuit also includes a pressure switch 42, calibrated to the appropriate vacuum level. This pressure switch is the "normally open" type and closes the electrical circuit when pressure reaches the predetermined threshold. The purpose of this pressure switch, which is mounted on pipe 18 (FIG. 2) is to open check valve 44 that consequently brings fresh air into pipe 18. The resulting fresh-air intake causes the mobile head 20 to release from valve 32 on the lid of the container, separating the two components (particularly due to the effect of the coiled lines 22 and 36, the hose and the power cord), and correlates to the opening of switch 34, no longer subject to mechanical pressure, shutting off the motor 16. The mobile head 20 can then automatically spring back to the storage position, due to the elasticity of the two coiled lines 22 and 36, which will return to the housing provided for them inside stationary unit 12.

The fact that the pump is deactivated indirectly, due to the opening of the air-flow circuit between pump 14 and aspirating nozzle 24, presents the advantage of being quite simple and extremely reliable. Moreover, unlike existing systems, it does not require any electronic circuitry. As a result, there is no need to resort to components likely to be less reliable in damp environments unless they are protected from humidity, which would entail additional costs.

Nevertheless, it is still possible to use an electronic circuit with a pressure sensor directly controlling motor shut-off. The air circuit would then gradually fill with air due to imperfect airtightness at the pump when the pump is stopped, making it possible for the mobile head to release from the container a little while after the motor shuts off.

More specifically, check valve 44 allowing fresh air to enter the circuit is opened by solenoid 46, which briefly receives a jolt of current from pressure switch 42. As soon as fresh air enters the circuit, pressure inside rises above the threshold which turns on the pressure switch, cutting off power to solenoid 46.

Figure 5:
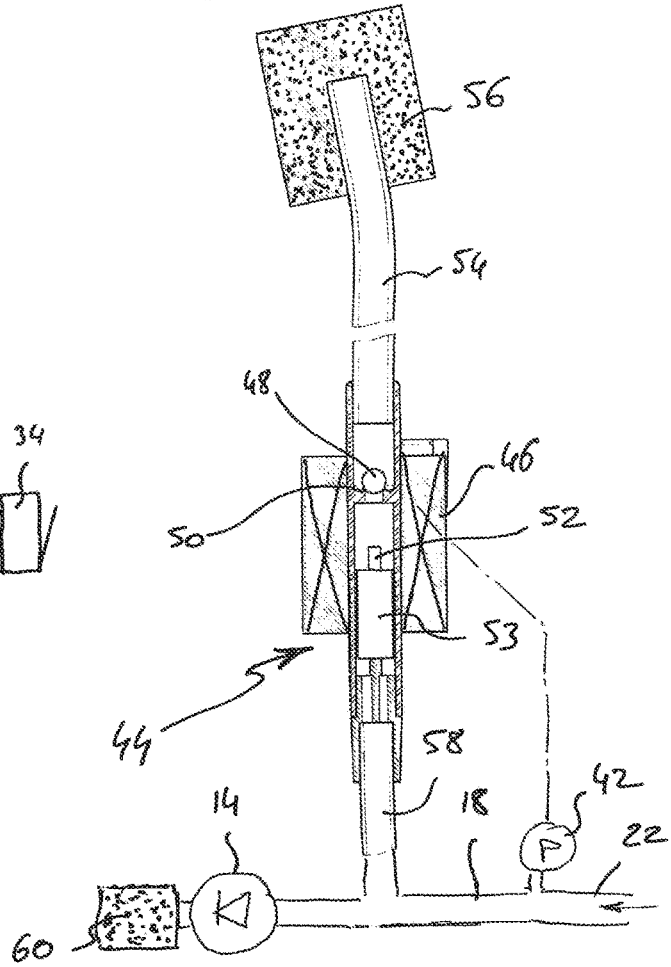
FIG. 5 is an air-flow diagram, showing in particular the details of the automatic venting device when vacuum packing is complete.

FIG. 5 is a detail illustration, based on the most advantageous build of the device, of the check valve vent controlled by solenoid 46.

The assembly is comprised of a ball 48 resting either in a seat 50 or on an O-ring, in such a way that ball 48 remains stuck to its seat 50 in the presence of a vacuum pipe 18 due to the suction effect of the pump 14.

A mobile lever 52 attached to metal part 53, made of magnetic metal, either forming a single part with the lever or attached to it, is placed in the core of solenoid 46. In the absence of current in the solenoid, part 53 possesses enough peripheral leeway to allow pressure to equalize on either side. When solenoid 46 is energized, the tip of lever 52 ejects the ball 48 off its seat 50. This action immediately opens the gateway between pipe 18 and tube 54, an opening inside the housing of the device. Fresh air can then flow into the tubing after filtering through the foam 56. The purpose of the foam unit 56 is to muffle the noise of the lever 52 hitting ball 48, while allowing air to enter the assembly.

Check valve 44 venting to fresh air, just described, is mounted on a bypass on pipe 18, via tube 58, the whole assembly being built into the stationary unit 12.

It should be noted that the fresh air venting system based on dislodging ball 48 provides a simple, sudden, and complete opening in the air circuit, which is required to cause the mobile head to release from the valve on the container lid.

To muffle noise emitted by pump 14 itself, a loud snapping typical of diaphragm pumps which is produced by the movement of the diaphragm, another piece of foam 60 is positioned in the conduit downstream of pump 14.

Figure 6:
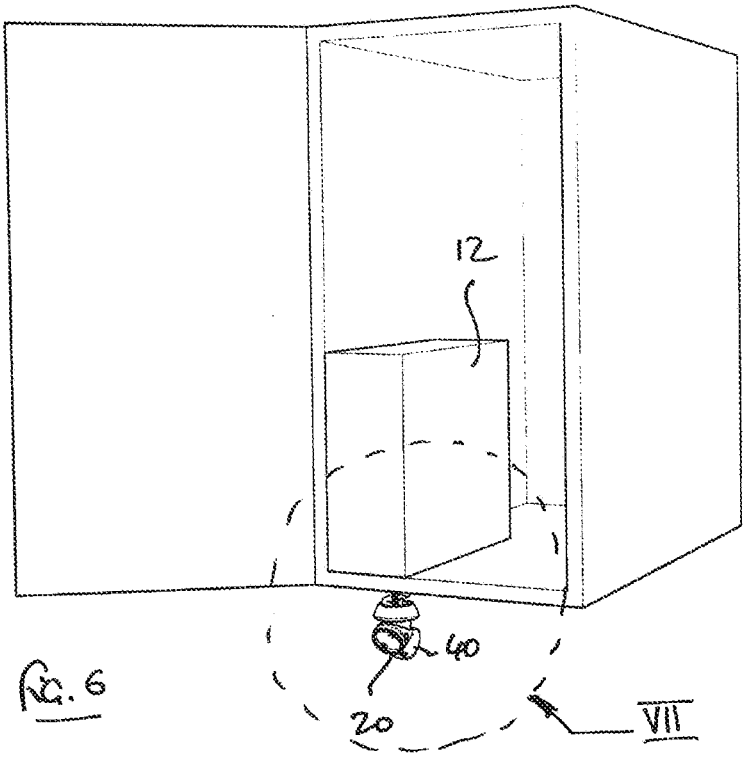
FIG. 6 illustrates a variant in the implementation of the present invention, in which the stationary unit is built into a cabinet.
Figure 7:
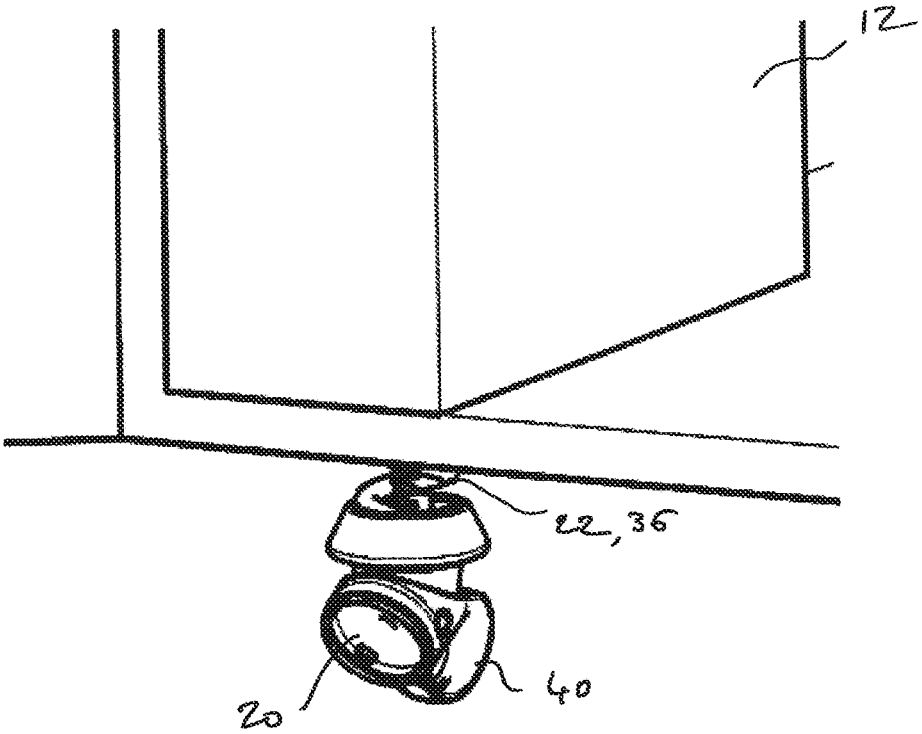
FIG. 7 represents the detail referred to as VII on FIG. 6.

FIGS. 6 and 7 (FIG. 7 corresponds to the detail identified as VII on FIG. 6) illustrate an alternative build of the invention, in which stationary unit 12, containing the motor, pump, and ventilation system, instead of being placed on a kitchen countertop, is built into a kitchen cabinet: an upper cabinet, for example. In this case, in the storage position, mobile head 20 sticks out of the bottom of the cabinet. The user need only grasp the pull tab 40 to pull the hose and mobile head down and apply the nozzle to the lid of a container placed on the countertop under this cabinet. When the vacuum has been produced and the pump is disactivated, mobile head 20 automatically retracts to its storage position due to the elasticity of the coiled lines 22, 36.

The invention claimed is:

1. A device (10) for vacuum-packing a product in an airtight container (28, 30) for the purpose of keeping the product fresh longer, the device comprising:

an electric motor (16);

a power-supply switch for the electric motor (34, 37);

a vacuum pump (14) driven by the electric motor, with piping (18) in which the vacuum pump creates negative air pressure, and an aspirating nozzle (24) connected to the piping and designed to form a temporary airtight coupling with a container valve (32) that is part of an airtight container, wherein the device comprises a stationary unit (12), containing the motor and vacuum pump, and a mobile head (20) separate from the stationary unit, the mobile head containing the aspirating nozzle, wherein the stationary unit and mobile head are connected by a coiled hose (22) which is flexible, linking the vacuum pump and aspirating unit, and wherein the coiled hose (22) can stretch from a storage position in which the mobile head rests on the stationary unit to an active mode in which the mobile head is coupled with the airtight container at some distance from the stationary unit;

and wherein the stationary unit further comprises a pressure switch on the piping, the pressure switch having a pressure threshold, the pressure switch causing a check valve to open and admit fresh air into the piping when the pressure threshold is reached, thereby causing the aspirating nozzle to separate from the container valve.

2. A device according to claim 1, wherein the mobile head (20) also includes the power-supply switch and wherein the stationary unit and mobile head are additionally connected by a coiled power cord (36) connecting the power-supply switch to the electric circuit of the motor of the pump, the coiled power cord being placed inside the coiled hose, such that the coiled hose and coiled power cord can be stretched together from the storage position to the active mode.

3. The device according to claim 1, wherein the coupling between the aspirating nozzle and the container valve consists of mere contact, without any lock.

4. The device according to claim 2, wherein the stationary unit is equipped with a housing (23) where the coiled hose and the coiled power cord are in a compressed form, in the storage position.

5. The device according to claim 1, wherein the mobile head includes a grip or tab (40) to facilitate the pulling of the mobile head, from the storage position to the active mode and the positioning of the mobile head on the container valve.

6. A device (10) for vacuum-packing a product in an airtight container (28, 30) for the purpose of keeping the product fresh longer, the device comprising:

an electric motor (16);

a power-supply switch for the electric motor (34, 37);

a vacuum pump (14) driven by the electric motor, with piping (18) in which the vacuum pump creates negative air pressure, and an aspirating nozzle (24) connected to the piping and designed to form a temporary airtight coupling with a container valve (32) that is part of an airtight container, wherein the device is separated into two sub-assemblies, specifically, a stationary unit (12), containing the motor and vacuum pump, and a mobile head (20), containing the aspirating nozzle, wherein the stationary unit and mobile head are connected by a flexible hose (22) linking the vacuum pump and aspirating unit, and wherein the hose (22) can stretch from the storage position in which the mobile head rests on the stationary unit to an active mode in which the mobile head is coupled with the airtight container at some distance from the stationary unit, a pressure switch on the piping, the pressure switch having a pressure threshold, the pressure switch causing a check valve in the stationary unit to open and admit fresh air into the piping when the pressure threshold is reached, thereby causing the aspirating nozzle to separate from the container valve.

7. A device (10) for vacuum-packing a product in an airtight container (28, 30) for the purpose of keeping the product fresh longer, the device comprising:

an electric motor (16);

a power-supply switch for the electric motor (34, 37);

a vacuum pump (14) driven by the electric motor, with piping (18) in which the vacuum pump creates negative air pressure, and an aspirating nozzle (24) connected to the piping and designed to form a temporary airtight coupling with a container valve (32) that is part of an airtight container, wherein the device is separated into two sub-assemblies, specifically, a stationary unit (12), containing the motor and vacuum pump, and a mobile head (20), containing the aspirating nozzle, wherein the stationary unit and mobile head are connected by a flexible hose (22) linking the vacuum pump and aspirating unit, and wherein the hose (22) can stretch from the storage position in which the mobile head rests on the stationary unit to an active mode in which the mobile head is coupled with the airtight container at some distance from the stationary unit, a pressure switch on the piping, the pressure switch being normally-open and having a pressure threshold, the pressure switch activating a solenoid which causes a check valve in the stationary unit to open and admit fresh air into the piping when the pressure threshold is reached, thereby causing the aspirating nozzle to separate from the container valve;

wherein the check valve (44) comprises a ball (48) resting in a seat (50) to which the ball clings in the presence of vacuum pressure in the piping (18), and a mobile lever (52) mounted on a magnetic metallic part (53) placed in a core tube of the solenoid (46), in such a way as to dislodge the ball and open the check valve when current flows through the solenoid under control of the pressure switch.

* * * * *